US005412286A

United States Patent [19]

Kazi et al.

[11] Patent Number: 5,412,286

[45] Date of Patent: May 2, 1995

[54] VARIABLE VOLTAGE BALLAST SYSTEM FOR MINI-FLUORESCENT LAMP

[75] Inventors: Ashfaq Kazi, Anaheim Hills; Syed M. A. Hussain, Diamond Bar, both of Calif.

[73] Assignee: American Power Products, Inc., Chino, Calif.

[21] Appl. No.: 70,215

[22] Filed: Jun. 2, 1993

[51] Int. Cl.[6] ..... H05B 37/00

[52] U.S. Cl. ..... 315/242; 315/244; 315/283; 315/276; 315/239

[58] Field of Search ..... 315/276, 244, 239, 242, 315/258, 262, 49, DIG. 1, DIG. 5, 283

[56] References Cited

U.S. PATENT DOCUMENTS 3,621,331 11/1971 Barron ..... 315/DIG. 7 X
4,350,929 9/1982 Katoogi ..... 315/49
5,179,323 1/1993 Ham ..... 315/276 X

*Primary Examiner*—Robert J. Pascal
*Assistant Examiner*—Haissa Philogene
*Attorney, Agent, or Firm*—Morton J. Rosenberg; David I. Klein

[57] ABSTRACT

An efficient ballast for Mini-fluorescent lamps, includes an inductor, in communication with a power source and constructed as transformer with only primary winding, a fluorescent lamp in series with the inductor, and a capacitor in series with the fluorescent lamp, and optionally may include a resistor in parallel with the coil, and a switch interposed between the capacitor and power source. The value of the capacitance may change based upon the degree of change in the supply voltage.

13 Claims, 1 Drawing Sheet

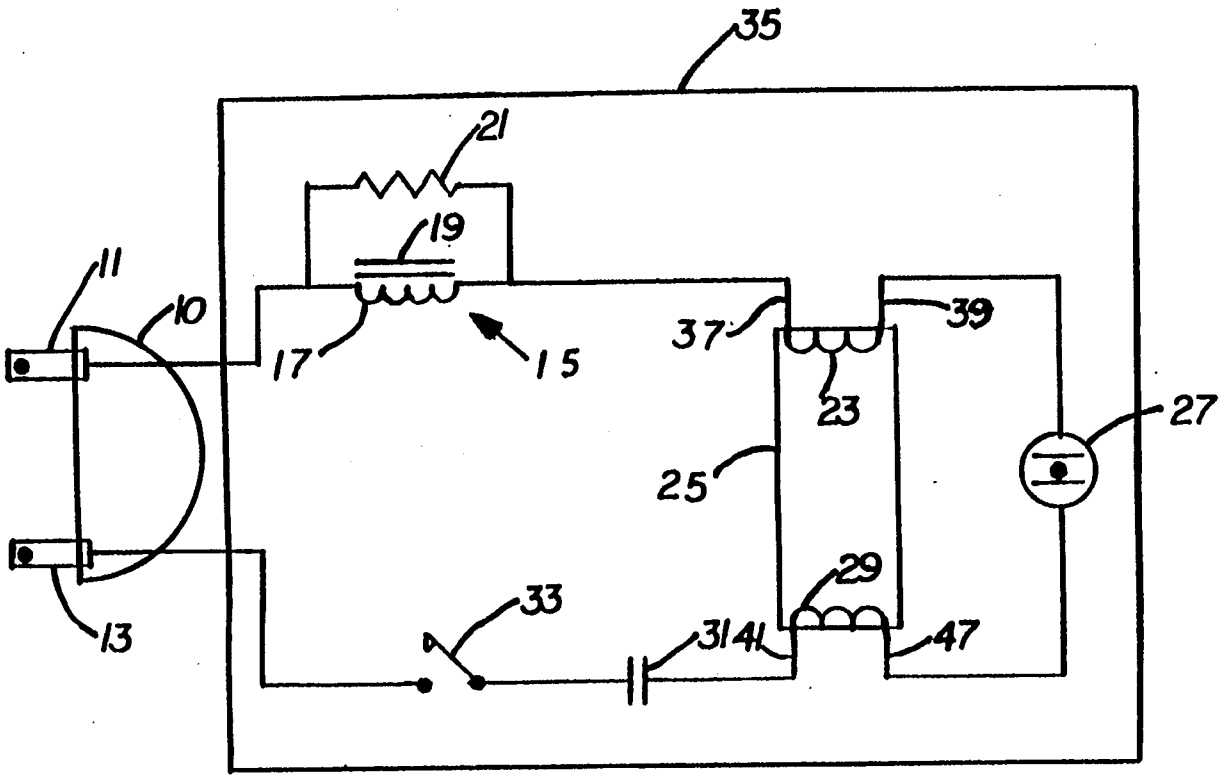
35
21
19
15
17
10
11
13
37
39
23
25
29
47
27
31
41
33

VARIABLE VOLTAGE BALLAST SYSTEM FOR MINI-FLUORESCENT LAMP

BACKGROUND OF THE INVENTION

The present invention relates to a ballast circuit for a fluorescent lamp. More precisely, the present invention relates to a compact ballast circuit having a capacitor in series with an inductor, such that the fluorescent lamp is interposed in series with capacitor and the inductor, and particularly where the inductor is formed using materials which are commonly available for use in transformers but having only a single winding.

Fluorescent lamps are becoming increasingly popular for use in the home or office because of their high operating efficiency as compared to incandescent lamps. Indeed, fluorescent lamps emit light at several times the efficiency of a typical incandescent lamp, and do not generate as much heat as a typical incandescent bulb, thereby conserving radiant energy and eliminating excess heat output.

A typical fluorescent lamp is constructed from a glass tube which contains two electrodes at opposite ends, a coating of powdered phosphor covering the interior of the tube, and small amounts of mercury. The major portions of a fluorescent lamp are the bulb, electrodes, fill gas, phosphor coating and a base used to support the external conductors of the electrodes. When energized, the electrodes provide a large potential between which free electrons initiate an arc. The arc generates some visible radiation, but mostly ultraviolet radiation, which in turn excites the phosphor coating causing it to emit light. In this process, the fluorescent effect is caused by the mercury when it is vaporized in the arc.

These fluorescent lamps require a ballast. A ballast is necessary to maintain constant current flow into the lamp. In a ballast resistor, for example, the resistance increases as the temperature increases. As resistance increases, less current is allowed through, thus lowering the temperature and consequently lowering the resistance. Current flow through the lamp is thus maintained at a constant level.

Larger fluorescent systems are well known and have involved larger scale, well known illumination electronics which have been optimized to one degree or another over the years. The techniques for optimizing these larger fluorescent systems include a variety of issues, especially pertinent to eliminating flicker, providing light which is suitable for reading and working, and providing adequate lighting in large industrial facilities. With smaller fluorescent lamps of lesser luminous intensity, in which less visible lighting is required, the circuit details must enable operation with efficiencies as high as the larger fluorescent systems.

As fluorescent lighting has gained acceptance for increasingly less formal and consequently smaller uses, the sizes of the fluorescent lamps and their systems have become smaller. The reduced scale of the fluorescent lights cannot generally be accomplished with a simple size reduction in the circuitry elements. Care must be taken to re-design the operating electronics to insure first that a size reduction may be had, and second that the power efficiency is present in the smaller sized lamps. This is especially so, since it is the power efficiency which generated the interest in a more widespread use of fluorescent lighting initially.

One such technique involved in down scaling is described in U.S. Pat. No. 5,179,323 to Byung L. Ham, entitled "Ballast for Mini Fluorescent Lamp," which issued on Jan. 12, 1993. The technique described therein uses a transformer having a shorted secondary winding to attempt to mitigate the effects of inductive heating. However, with regard to the cost of materials involved in mass production of mini-fluorescent lamps, a small savings per lamp translates into significant savings in view of the larger numbers of mini lamps produced. The use of a transformer secondary in a closed loop fashion is associated with a significant cost including the cost of the wire for the secondary winding, the cost of its coating, and the cost of winding it on a transformer core without damaging the primary winding, and the labor and extra process time involved. Further, the use of a transformer with a shorted secondary requires a secondary impedance match as the energy is transformed through the transformer.

The use of a ballast circuit containing a shorted secondary would require a change in the transformer if the operating conditions changed, such as a change to a higher supply voltage. With a higher supply voltage, the secondary current would significantly increase causing an even more significant increase in the waste power in the secondary according to the relationship $P=I^2R$. Thus, a new, two winding transformer would be needed for each size mini-fluorescent lamp and for each level of input power.

What is needed is a very simple mini-fluorescent ballast circuit, one has an inductive element which eliminates the significant cost associated with a secondary winding, and preferably which will enable the use of a single inductive element with a given mini-fluorescent lamp with changing conditions, such as input power. These and other objects are met with the ballast circuit of the present invention.

SUMMARY OF THE INVENTION

The ballast circuit of the present invention uses an inductive element, a mini-fluorescent lamp, and a capacitive element in series with the terminals of a source of electric power. The mini-fluorescent lamp thus depends upon the voltages and currents existing between the inductive and capacitive elements. An on/off switch is preferably interposed between the capacitive element and the terminal of the source of power. A resistor is preferably connected in parallel with the terminals of the inductive element.

BRIEF DESCRIPTION OF THE DRAWING

The invention will be best described with reference to the Drawing which is a schematic of the ballast circuit for a mini-fluorescent lamp.

DETAILED DESCRIPTION OF THE PREFERRED EMBODIMENT

The description and operation of the invention will be presented with reference to the electrical schematic illustrated in the single Figure. A source of 60 Hz alternating current power is applied to a pair of terminals on a plug 10, including a first terminal 11 and a second terminal 13. Terminal 11 of the power source is connected to one end of an iron core inductor 15.

The inductor 15 is preferably made in a manner similar to that for a transformer, but having only one winding. Inductor 15 has a winding 17 and a core 19. The core is preferably a laminated steel core having a size of about EI25.5. The designation EI relates to a transformer core structure having an "E" shaped cross section with a cover or "I" shaped flux member lying adjacent the open portion of the "E." The numerical designation 25.5 relates to the size in centimeters, which is roughly equal to one inch. This dimension represents the "height" of the "E" portion. The overall dimensions of this structure is about one inch by about one inch.

The inductor 15 ideally is constructed with a small plastic transformer spool, and should have, in a preferred embodiment, about 560 turns of No. 31 AWG wire. Inductor 15 may have an inductive value of from about 50 millihenries to about 75 millihenries. The circuit of the present invention is believed to require lesser turns of wire than other inductive elements used in ballast circuits, resulting in less heat generated due to a lesser length of resistive wire in the turns. The iron core 19 increases the inductance of inductor 15. However, the inductor 15 will have only a single winding 17.

A resistor 21 is connected in parallel with inductor 15. Certain fluorescent lamps and or certain makes of fluorescent lamps may be more susceptible to flickering than others. To dampen this effect, the resistor 21, which may preferably be a one fourth watt—150 OHM resistor, is added in parallel with the inductor 15. The resistor also acts as a safety to the inductor 15 by channeling the excessive current draw through the resistor 21 rather than the inductor 15, which current can damage the inductor 15 by intense heat during periods of abnormal excessive current draw.

In the Figure, the inductor 15 is connected to a first electrode 23 of a fluorescent lamp 25. The first electrode 23 is also connected to one terminal of a glow bottle 27, which may preferably be a type GB22 which is commercially available from the Sylvania Corporation. The other terminal of a glow bottle 27 is connected to a second electrode 29 of the fluorescent lamp 25. The lamp may be a four watt lamp, available from the Sylvania Corporation and several other suppliers; it is hereafter referred to as a mini-fluorescent lamp.

The second electrode 29 of the mini-fluorescent lamp 25 is connected to a capacitor 31. Capacitor 31 preferably is of the metalized polyester type. The present ballast circuit permits its use with different alternating current voltages for plug 10 with the need to change the values of only a single circuit element, namely capacitor 31.

The circuit of the ballast for a mini-fluorescent lamp 25 of the present invention is constructed such that the same inductor 15 with only one winding can be used to operate mini-fluorescent lamps having power consumption rates of from about three watts to about nine watts, even at different supply voltages, with the value of the capacitor 31 should be selected to correspond to the supply voltage. The inductor 15 used in the circuit of the present invention can be used for supply voltages of both 100–150 volts and for supply voltages of 200–250 volts. The capacitor would be the only element in the circuit which would change to accommodate a changing supply voltage. This would enable a greater quantity of the same inductive element to be ordered for a variety of fluorescent lamps fixtures, having different voltage ratings, and at a lower price due to such greater quantities. Such a change does not involve additional cost due to the equivalency of cost of the changing capacitances. When used with a mini-fluorescent lamp 25 having a three to four watt power consumption and having a supply voltage of from about 100 volts to about 150 volts RMS (root mean square) applied to plug 10, and with the present inductor 15, the capacitor 31 should have a value of about 2.8 microfarads. A supply voltage of from about 100 volts to about 150 volts normally has a nominal value of about 120 volts RMS.

However, for the same mini-fluorescent lamp 25, the same inductor 15 and the same circuit configuration, but when used with a supply voltage of from about 200 volts to about 250 volts, the capacitor 31 should have a value of about 1.8 microfarads. A supply voltage of from about 200 volts to about 250 volts normally has a nominal value of about 240 volts. Further refinement and safety to the circuit can be provided by adjusting the value of resistor 21, if desired. The resistor 21 may be optional, but when it is used in the circuit, its value may vary from about 75 ohms to about 350 ohms.

The use of a capacitor 31 having a larger size enables the use of a more economical smaller inductor 15, which is further economically made with a transformer core 19, but with only a single winding 17. Also, the heat build-up is very low due to the fewer turns of wire in winding 17, thereby increasing the life of the components and resulting in increased energy efficiency.

The other terminal of capacitor 31 may be optionally attached to one end of a switch 33, where it is desired to have switchable control. Several brands of small fluorescent lights do not have such a switch 33, and rely upon being plugged into and from a wall outlet to operate the lamp. However, in cases where it is desired to leave the lamp plugged into the wall, a switch 33 will facilitate the easy operation of the circuit of the present invention, and the turning on and off of the mini-fluorescent lamp 25. The other end of the switch 33 is connected to the terminal 13 of a source of 60 Hz alternating current power.

Also shown in the Figure is a housing 35 within which the circuitry components and mini-fluorescent lamp 25 may be supported and mounted. Further, although the plug 10 is shown schematically separate from the housing 35, plug 10 may be made integrally with housing 35 such that the circuit of the present invention, and the mini-fluorescent light 25 may be mounted wholly or partially within and supported by the housing 35.

The mini-fluorescent lamp 25 is shown as connected with optional connectors 37, 39, 41, and 43 which will allow the fluorescent lamp to be removed from the circuit easily, should it need to be replaced. Such connectors 37, 39, 41, and 43 may be of the twist type or lateral clip type. Often, the fluorescent lamp 25 may be hard wired to its electronics, especially where the lighting units may be made so inexpensively as to be disposable.

Although the invention has been described with reference to a particular illustrative embodiment thereof, many changes and modifications of the ballast circuit of the present invention will be apparent to those skilled in the art without departing from the spirit and scope of the invention. Therefore, included within the patent warranted hereon are all such changes and modifications as may reasonably and properly be included within the scope of this contribution to the art.

What is claimed is:

1. A ballast system for a low power fluorescent lamp adaptable to changes in system input conditions, comprising:

(a) a plug having a pair of terminals for electrical connection thereto of an AC input power source;

(b) an inductive element having a single inductive winding coupled in series relation to said AC input power source and said low power fluorescent lamp whereby said inductive element remains operable in regulating the current through said low power fluorescent lamp for an input power source root mean square voltage within the range from approximately 100 to 250 volts; and, (c) a capacitive element coupled in series relation to said AC input power source and said lower power fluorescent lamp having a predetermined capacitance value corresponding to a given combination of said inductive element inductance and said input power source root mean square voltage values, whereby a replacement of only said capacitive element being sufficient to compensate said ballast system for variations in said input power source root mean square voltage within said root mean square voltage range.

2. The ballast system as recited in claim 1 where said inductive winding is wound on a transformer coil.

3. The ballast system as recited in claim 2 where said transformer coil is of an EI type.

4. The ballast system as recited in claim 1 where said inductive element has an inductance value in the range from approximately 50 millihenries to 75 millihenries.

5. The ballast system as recited in claim 4 where said inductive winding of said inductive element is formed by approximately 560 turns of number 31 AWG wire.

6. The ballast system as recited in claim 5 where said alternating current input power source has a root mean square voltage from approximately 100 to 150 volts and where said capacitive element has a capacitance value of approximately 2.8 microfarads.

7. The ballast system as recited in claim 5 where said alternating current input power source has a root mean square voltage from approximately 200 to 250 Volts and where said capacitive element has a capacitance value of approximately 1.8 microfarads.

8. The ballast system as recited in claim 1 where a resistive element is electrically connected in parallel with said inductive element.

9. The ballast system as recited in claim 8 where said resistive element has a resistance value in the range of approximately 75 to 350 ohms.

10. The ballast system as recited in claim 1 where a switch is electrically connected in series between a lead of said capacitive element and one of said terminals of said plug.

11. The ballast system as recited in claim 10 where said ballast system includes a glow bottle for electrical connection in parallel with said low power fluorescent lamp.

12. The ballast system as recited in claim 11 where said ballast system includes a housing for supporting said glow bottle, said low power fluorescent lamp, said inductive element, and said capacitive element.

13. The ballast system as recited in claim 12 where said housing supports said plug.

* * * * *